US006793892B1

(12) United States Patent
Niermann

(10) Patent No.: US 6,793,892 B1
(45) Date of Patent: Sep. 21, 2004

(54) DEVICE AND METHOD FOR SEPARATING COMPONENTS OF A FLUID SAMPLE

(76) Inventor: Volker Niermann, 196B Main St., Little Falls, NJ (US) 07424

( * ) Notice: Subject to any disclaimer, the term of this patent is extended or adjusted under 35 U.S.C. 154(b) by 57 days.

(21) Appl. No.: 09/694,996

(22) Filed: Oct. 24, 2000

Related U.S. Application Data

(60) Provisional application No. 60/169,172, filed on Dec. 6, 1999.

(51) Int. Cl.[7] ..... B01L 9/00

(52) U.S. Cl. ..... 422/101; 210/516; 210/518; 210/102

(58) Field of Search ..... 436/68, 45, 66, 436/16; 604/501; 422/72, 73, 101, 102; 204/628; 210/516, 518

(56) References Cited

U.S. PATENT DOCUMENTS

| | | | | | |
|---|---|---|---|---|---|
| 3,852,194 | A | * | 12/1974 | Zine, Jr. | 210/83 |
| 3,897,343 | A | * | 7/1975 | Ayres | 210/516 |
| 3,931,018 | A | * | 1/1976 | North, Jr. | 210/359 |
| 3,976,579 | A | * | 8/1976 | Bennett | 210/516 |
| 4,012,325 | A | * | 3/1977 | Columbus | 210/516 |
| 4,180,465 | A | * | 12/1979 | Murty | 210/516 |
| 4,295,974 | A | * | 10/1981 | Cornell | 210/789 |
| 4,308,232 | A | * | 12/1981 | Crouther et al. | 422/102 |
| 4,315,892 | A | * | 2/1982 | Stone et al. | 422/101 |
| 4,492,634 | A | * | 1/1985 | Villa-Real | 210/398 |
| 4,853,137 | A | * | 8/1989 | Ersson | 210/782 |
| 4,877,520 | A | * | 10/1989 | Burns | 210/94 |
| 4,917,801 | A | * | 4/1990 | Luderer et al. | 210/516 |
| 4,946,601 | A | * | 8/1990 | Fiehler | 210/782 |
| 5,019,243 | A | * | 5/1991 | McEwen et al. | 210/94 |
| 5,030,341 | A | * | 7/1991 | McEwen et al. | 210/515 |
| 5,236,604 | A | * | 8/1993 | Fiehler | 210/515 |
| 5,266,199 | A | * | 11/1993 | Tsukagoshi et al. | 210/514 |
| 5,308,506 | A | * | 5/1994 | McEwen et al. | 210/515 |
| 5,560,830 | A | * | 10/1996 | Coleman et al. | 210/695 |
| 5,632,895 | A | * | 5/1997 | Tsukagoshi et al. | 210/516 |
| 5,901,402 | A | * | 5/1999 | Williams | 15/144.1 |
| 6,277,331 | B1 | * | 8/2001 | Konrad | 210/516 |
| 6,406,671 | B1 | * | 6/2002 | DiCesare et al. | 210/514 |

FOREIGN PATENT DOCUMENTS

| | | | |
|---|---|---|---|
| EP | 0 638 804 A1 | | 11/1994 |
| EP | 1 006 360 A2 | | 7/2000 |
| EP | 1006360 | * | 7/2000 |
| WO | WO 98/05426 | * | 2/1998 |
| WO | WO 98/51411 | * | 11/1998 |

OTHER PUBLICATIONS

Merriam–Wegster's Collegiate Dictionary.*
Encyclopedia Britannica Online http://www.search.eb.com "specific gravity" and "hollow".*

* cited by examiner

*Primary Examiner*—Jill Warden
*Assistant Examiner*—Elizabeth Quan
(74) *Attorney, Agent, or Firm*—Nanette S. Thomas, Esq.; Scott J. Rittman, Esq.; Mark Lindsey

(57) ABSTRACT

A specimen collection and separation assembly is provided. The assembly includes a tube having closure secured to the open top of the tube. The closure includes a section that is pierceable by a needle cannula for depositing a liquid specimen in the tube. A separator is disposed in the tube below the closure. The separator includes top and bottom ends. Portions of the separator adjacent the top define a resiliently deformable low density sealing plug dimensioned to sealingly engage the interior of the tube. A high density ring is integrally engaged with the seal and extends to the bottom of the separator. The relative densities and dimensions of the seal and the ring are selected to achieve an overall density between densities of the phases of liquid to be separated. The ring causes the seal to elongate in response to forces imposed by a centrifuge. The separator then will move to a position in the tube between the respective phases of the specimen being separated. Termination of the centrifugal load causes the seal to return to its initial shape and for isolating the separated phases of the specimen.

14 Claims, 4 Drawing Sheets

DEVICE AND METHOD FOR SEPARATING COMPONENTS OF A FLUID SAMPLE

This application claims the benefit of Provisional application Ser. No. 60/169,172, filed Dec. 6, 1999.

BACKGROUND OF THE INVENTION

1. Field of the Invention

This invention relates to a device and method for separating heavier and lighter if, fractions of a fluid sample. More particularly; this invention relates to a device and method for collecting and transporting fluid samples whereby the device and fluid sample are subjected to centrifugation in order to cause separation of the heavier fraction from in the lighter fraction of the fluid sample.

2. Description of Related Art

Diagnostic tests may require separation of a patient's whole blood sample into components, such as serum or plasma, the lighter phase component, and red blood cells, the heavier phase component. Samples of whole blood are typically collected by venipuncture through a cannula or needle attached to a syringe or an evacuated collection tube. Separation of the blood into serum or plasma and red blood cells is then accomplished by rotation of the syringe or tube in a centrifuge. Such arrangements use a barrier for moving into an area adjacent the two phases of the sample being separated to maintain the components separated for subsequent examination of the individual components.

A variety of devices have been used in collection devices to divide the area between the heavier and lighter phases of a fluid sample.

The most widely used device includes thixotropic gel materials such as polyester gels in a tube. The present polyester gel serum separation tubes require special manufacturing equipment to prepare the gel and to fill the tubes. Moreover, the shelf-life of the product is limited in that overtime globules may be released from the gel mass. These globules have a specific gravity that is less than the separated serum and may float in the serum and may clog the measuring instruments, such as the instrument probes used during the clinical examination of the sample collected in the tube. Such clogging can lead to considerable downtime for the instrument to remove the clog.

No commercially available gel is completely chemically inert to all analytes. If certain drugs are present in the blood sample when it is taken, there can be an adverse chemical reaction with the gel interface.

Therefore, a need exists for a separator device that (i) is easily used to separate a blood sample; (ii) is independent of temperature during storage and shipping; (iii) is ti stable to radiation sterilization; (iv) employs the benefits of a thixotropic gel barrier yet avoids the many disadvantages of placing a gel in contact with the separated blood components; (v) minimizes cross contamination of the heavier and lighter phases of the sample during centrifugation; (vi) minimizes adhesion of the lower and higher density materials against the separator device; (vii) is able to move into position to form a barrier in less time than conventional methods and devices; (viii) is able to provide a clearer specimen with less cell contamination than conventional methods and devices; and (ix) can be used with standard sampling equipment.

SUMMARY OF THE INVENTION

The present invention is a method and assembly for separating a fluid sample into a higher specific gravity phase and a lower specific gravity phase. Desirably, the assembly of the present invention comprises a plurality of constituents. Preferably, the assembly comprises a container and a composite element.

Most preferably, the container is a tube and the composite element is a separator arranged to move in the tube under the action of centrifugal force in order to separate the portions of a fluid sample.

Most preferably, the tube comprises an open end, a closed end and a sidewall extending between the open end and closed end. The sidewall comprises an outer surface and an inner surface. The tube further comprises a closure disposed to fit in the open end of the tube with a resealable septum. Preferably, the separator element is releaseably positioned at the open end of the tube with the closure. Alternatively, the separator element may also be releasably positioned at the closed end of the tube.

Alternatively, both ends of the tube may be open, and both ends of the tube may be sealed by elastomeric closures. At least one of the closures of the tube may include a needle pierceable resealable septum.

Preferably, the separator is sealingly engaged with portions of the tube near the open top. The separator may be formed from a needle-pierceable resealable material that enables a needle cannula to be passed therethrough for depositing a specimen into the tube. The separator may be formed from a material that exhibits good sealing characteristics against the inner surface of the cylindrical sidewall of the tube, and may be diametrically dimensioned for sealing engagement against the sidewall of the tube. Thus the separator will isolate material on one side of the separator from material on the opposed side of the separator.

The separator may comprise a resiliently deformable material, such as thermoplastic elastomeric foam. The elastomeric portions of the separator are readily deformable and provide desirable sealing characteristics against the sidewall of the tube.

The separator further comprises a higher density portion integrally engaged with or embedded in the less dense elastomer. The more dense material preferably is disposed at a lower end of the separator. Thus, the higher density material functions to deform the separator downwardly into a smaller cross-sectional dimension during centrifugation. The more dense material also functions to define an overall specific gravity or density for the separator that lies between the specific densities of the different phases of blood or other such liquid to be separated. The elastomeric portions of the separator may be at least partly hollowed to facilitate the deformation during centrifugation and to facilitate the needle piercing.

In use, a fluid enters the assembly by needle. The needle penetrates the closure and through the foam or other elastomeric portions of the separator. The needle is withdrawn from the assembly and the septum of the closure and the separator reseals. The assembly then is placed in a centrifuge, and a centrifugal load is applied. The centrifugal load causes the more dense material embedded at the lower end of the separator to move downwardly in the tube, thereby elongating the separator and reducing the cross-sectional dimensions of the separator. As a result, the separator is able to move freely within the tube and moves into contact with the fluid to be separated. Simultaneously, the more dense phase of the fluid will move toward the lower end of the tube, while the less dense phase of the fluid will flow around the separator. The fluid eventually will be substantially divided into two separate phases with the separator positioned between the respective phases. The centrifuge then is stopped, and the elastomeric portion of the separator resiliently returns to its initial shape in sealing engagement with inner surfaces of the tube. Thus, the separator substantially separates the phases of blood and enables the respective phases to be separately analyzed.

DESCRIPTION OF THE DRAWINGS

The assembly of the present invention is advantageous over existing separation products that use gel. In particular; the assembly of the present invention will not interfere with analytes as compared to gels that may interfere with analytes. Another attribute of the present invention is that the assembly of the present invention will not interfere with therapeutic drug monitoring analytes.

Another notable advantage of the present invention is that fluid specimens are not subjected to low density gel residuals that are at times available in products that use gel.

A further attribute of the present invention is that there is no interference with instrument probes.

Another attribute of the present invention is that samples for blood banking tests are more acceptable than when a gel separator is used.

Another attribute of the present invention is that only the substantially cell-free serum fraction of a blood sample is exposed to the top surface of the separator, thus providing practitioners with a clean sample.

Additionally, the assembly of the present invention does not require any additional steps or treatment by a medical practitioner, whereby a blood or fluid sample is drawn in the standard fashion, using standard sampling equipment.

Figure 1:
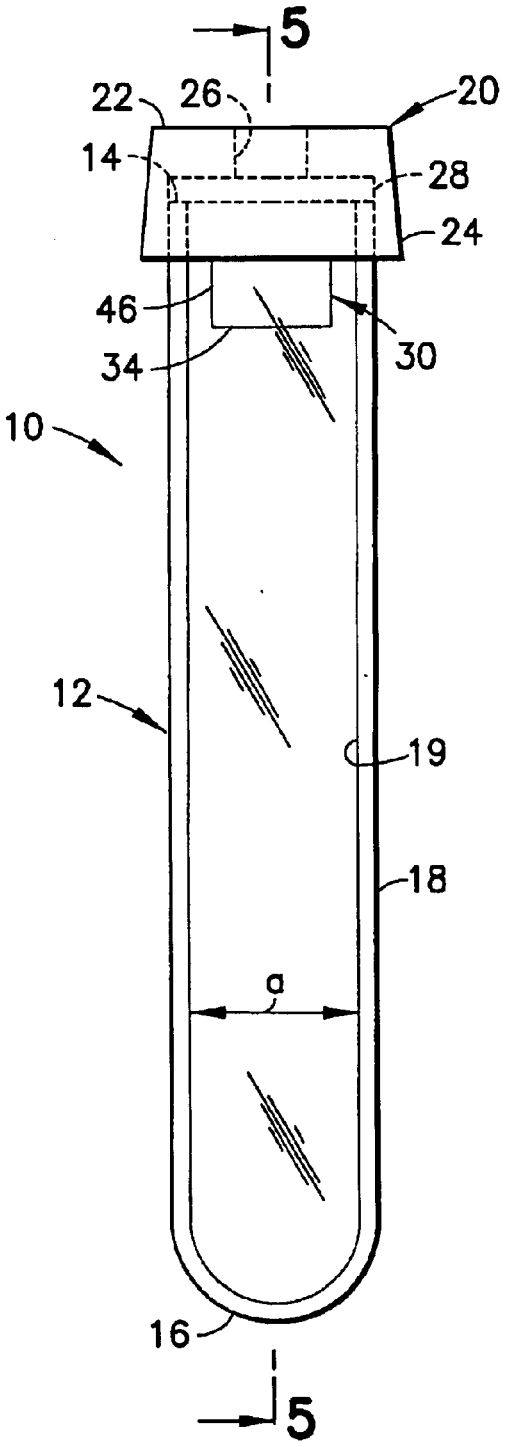

FIG. 1 is a front elevational view of the assembly of the present invention.

Figure 2:
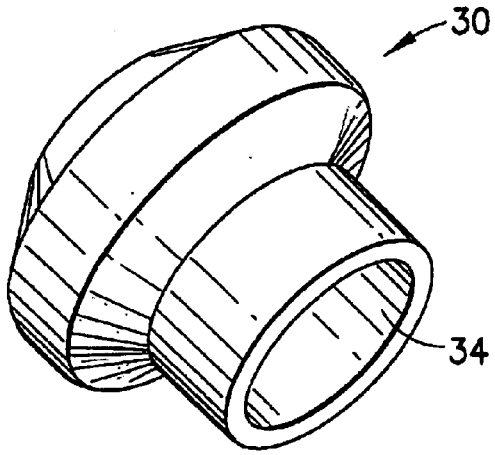

FIG. 2 is a perspective view of the separator in the assembly of FIG. 1.

Figure 3:
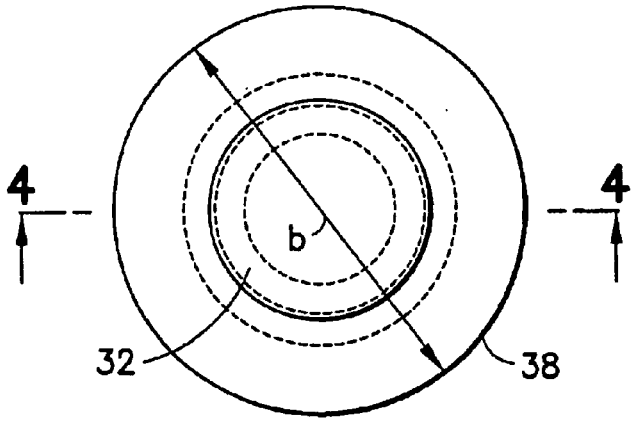

FIG. 3 is a top plan view of the separator of FIG. 2

Figure 4:
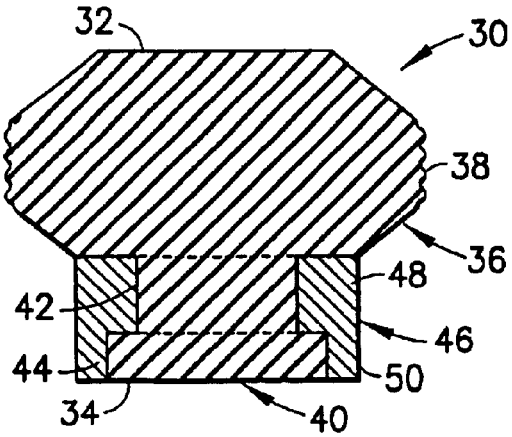

FIG. 4 is a cross sectional view of the separator of FIG. 3 taken along line 4—4 thereof.

Figure 5:
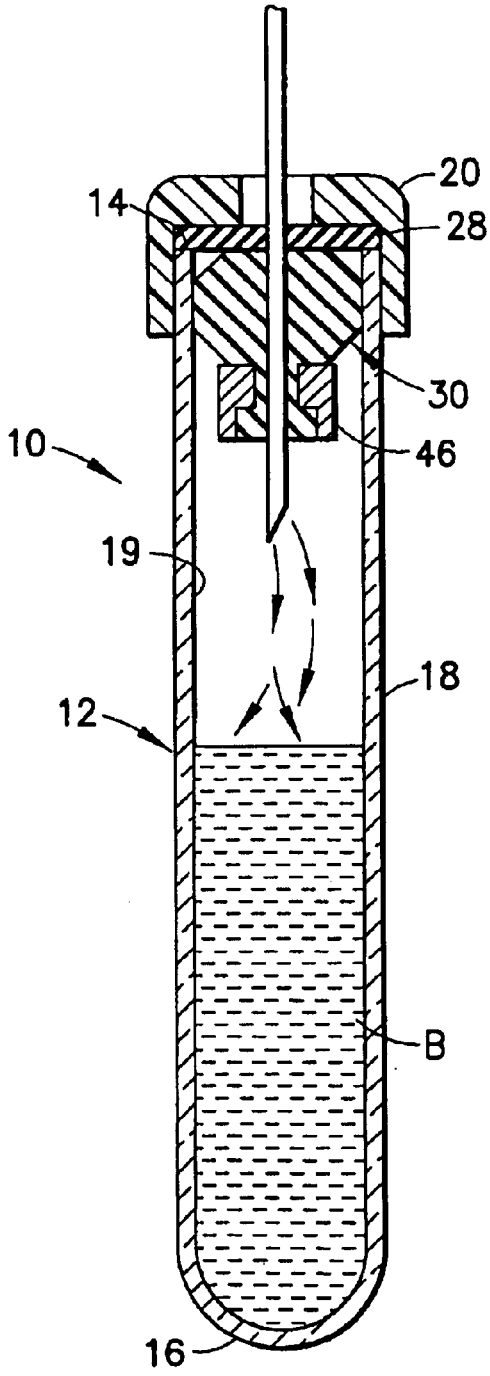

FIG. 5 is a longitudinal cross-sectional view of the assembly of FIG. 1 taken along 5—5 thereof illustrating fluid delivery into the assembly by a needle.

Figure 6:
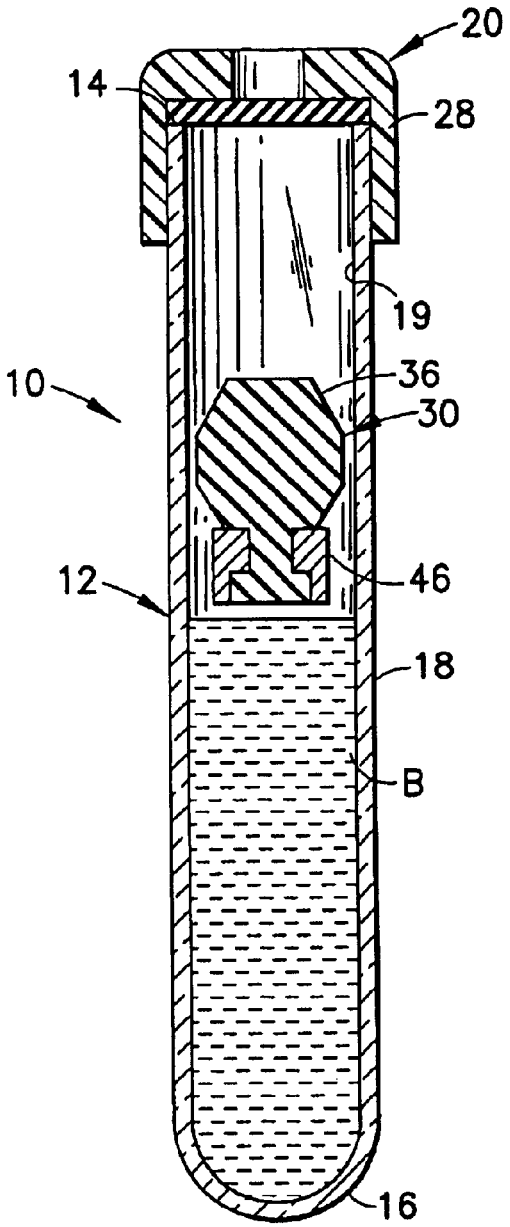

FIG. 6 is a cross-sectional view of the assembly under centrifugation and the release of the separator from the top of the tube.

Figure 7:
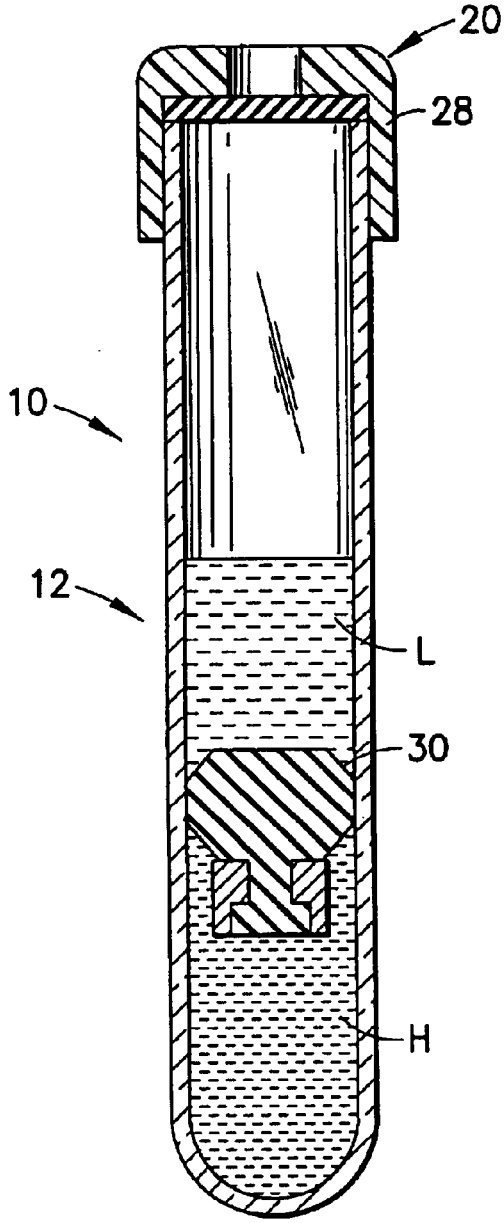

FIG. 7 is a cross-sectional view of the assembly after centrifugation and the separation of the liquid sample into higher and lower specific gravities.

Figure 8:
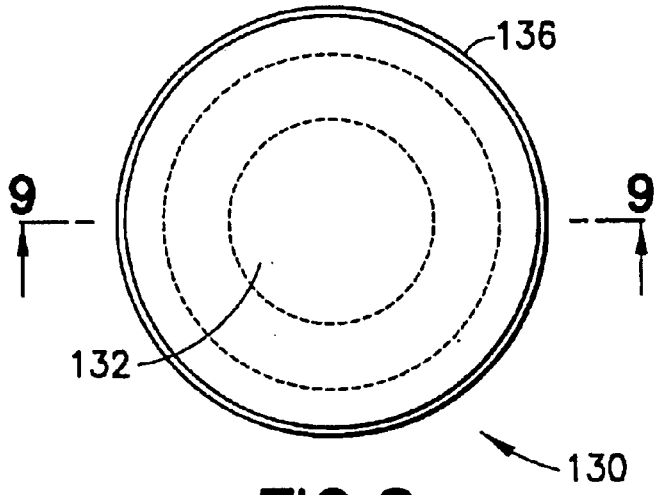

FIG. 8 is a top plan view of an alternate separation device.

Figure 9:
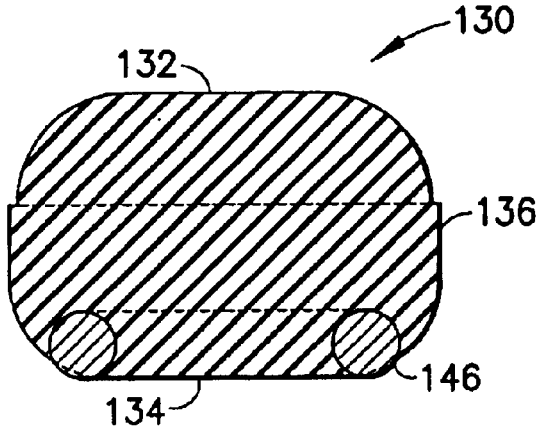

FIG. 9 is a cross-sectional view taken along line 9—9 in FIG. 8.

Figure 10:
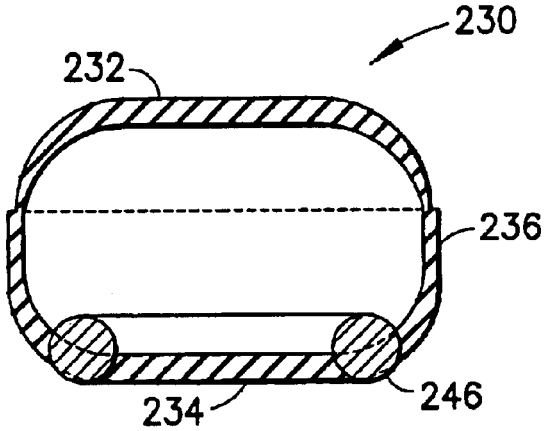

FIG. 10 is a cross-sectional view similar to FIG. 9, but showing an alternate embodiment of the separation device.

DETAILED DESCRIPTION

The present invention may be embodied in other specific forms and is not limited to any specific embodiments described in detail, which are merely exemplary. Various other modifications will be apparent to and readily made by those skilled in the art without departing from the scope and spirit of the invention. The scope of the invention will be measured by the appended claims and their equivalents.

The present invention illustrated in FIGS. 1 and 5–7, wherein assembly 10 comprises a tube 12, a closure 20 and a separator 30.

Tube 12 comprises an open top 14, a closed bottom 16 and a cylindrical sidewall 18 extending therebetween. Sidewall 18 of tube 12 has an inner surface 19 which defines a constant inside diameter "a".

Closure 20 comprises a cylindrical top wall 22 and a downwardly depending cylindrical skirt 24. Skirt 24 is dimensioned to telescope closely over portions of cylindrical sidewall 18 of tube 12 in proximity to open top 14. Top wall 22 is generally annular and includes a central aperture 26. Closure 20 further includes an elastomeric sealing layer 28 disposed adjacent portions of top wall 22 bounded by skirt 24 and extending continuously across aperture 26 in sidewall 22. Sealing layer 28 is formed from a material that will sealingly engage open top 14 of tube 12 and that will reseal itself after piercing by a needle.

Separator 30, as also shown in FIGS. 2–4, includes opposed top and bottom ends 32 and 34. Portions of separator 30 adjacent top end 32 define a toroidal seal 36. Toroidal seal 36 is unitarily molded from a thermoplastic elastomer, such as a low density foam that is deformable, pierceable by a needle, resealable and sealingly engageable with adjacent surfaces. Toroidal seal 36 includes an intermediate portion 38 an outside diameter "b" which is slightly greater than inside diameter "a" of tubular sidewall 18 of tube 12. As a result, intermediate portion 38 of seal 36 will sealingly engage inner circumferential surface of cylindrical sidewall 18 of tube 12. Portions of seal 36 will sealingly engage inner circumferential surface of cylindrical sidewall 18 of tube 12. Portions of seal 36 above and below intermediate portion 38 are tapered to smaller cross-sectional dimensions.

Separator 30 further includes a ballast mount 40 extending unitarily from seal 36 to bottom end 34 of separator 30. Ballast mount 40 includes a small diameter cylindrical neck 42 adjacent seal 36 and a large diameter flange 44 adjacent bottom end 34.

Separator 30 further includes a high density ballast ring 46 securely engaged around ballast mount 40. Ring 46 is of stepped tubular configuration, and includes a top portion 48 with an inside diameter approximately equal to the diameter of neck 42 of mount 40. High density ring 46 further includes a bottom portion 50 with an inside diameter approximately equal to the diameter of flange 44 of mount 40. Ring 46 can be securely engaged on mount 40 by merely deforming flange 44 of mount 40 sufficiently for top portion 48 of ring 46 to pass upwardly and beyond flange 44. When ring 46 abuts seal 36 of separator 30, flange 44 of mount 40 will resiliently return to its initial position for securely engaging top portion 48 of ring 46 between flange 44 and seal 36. Ring 46 preferably is formed from a metal that will be substantially non-reactive with the liquid to be collected and separated in assembly 10. Additionally, ring 46 is dimensioned to provide an overall specific gravity for separator 30 that will be between the respective gravities of the separated phases of the liquid specimen that will be deposited in tube 12.

Assembly 10 is assembled by inserting bottom end 34 of separator 30 into open top end 14 of tube 12. Separator 30 is urged sufficiently into tube 12 for top end 32 of separator 30 to substantially align with open top end 14 of tube 12. Closure 20 then is telescoped over open top end 14 of tube 12 such that the sealing layer 28 of closure 20 sealingly engages against open top 14 of tube 12.

As shown in FIG. 5, a liquid sample B is delivered to the tube that penetrates closure 20 and through central portions of separator 30. For purposes of illustration only, the liquid sample is blood.

As shown in FIG. 6, when subjected to a centrifugal load high density ring 46 moves toward bottom end 16. The movement of ring 46 caused by the applied centrifugal load elongates seal 36 and causes intermediate portion 38 of seal 36 to move out of sealing engagement with inner surface 19 of cylindrical sidewall 18 of tube 12. This separation of intermediate portion 38 from sidewall 18 of tube 12 enables separator 30 to move toward bottom end 16 of tube 12 in response to the centrifugal load. Simultaneously, blood deposited in tube 12 will separate into the low density liquid phase "L" and the high density formed phase "H". The average specific gravity of separator 30 lies substantially between the specific gravities of separated phases "L" and "H" of the blood "B". Hence, separator 30 will position itself substantially between the phases "L" and "H" as shown in FIG. 7.

The centrifuge is stopped after sufficient separation of phases "L" and "H" of the liquid specimen. Upon termination of the centrifugal load, separator 30 will return substantially to its initial shape with intermediate portion 38 sealingly engaging inner circumferential surface 19 of cylindrical sidewall 18 of tube 12. Separated phases "L" and "H" then may be accessed and analyzed separately.

FIGS. 8 and 9 show an alternate separator 130. Separator 130 includes a top end 132, a bottom end 134 and a seal portion 136 extending therebetween. Seal portion 136 is unitarily molded from a thermoplastic elastomer, and preferably a low density form. An intermediate section of seal portion 136 is dimensioned to sealingly engage inner surface 19 of cylindrical sidewall 18 of tube 12.

Separator 130 further includes a metallic ring 146 embedded in portions of separator 130 substantially adjacent bottom end 134 thereof. Ring 146 may, for example, be insert molded to remaining low density foam portions of separator 130.

Separator 130 is assembled and performs substantially as the above-described first embodiment. More particularly, bottom end 134 of separator 130 is urged into open top end 14 of tube 12. Closure 20 then is mounted to open top end 14 of tube 12 substantially as described above. A sample of blood or other liquid to be analyzed then is inserted into the tube assembly as described above, and the tube assembly then is centrifuged. The centrifugal load applied by the centrifuge causes metallic ring 146 to move downwardly in tube assembly 10, thereby elongating separator 130. This elongation enables separator 130 to move toward the bottom end of the tube in response to centrifugal loads, and further enables the low density phase of the blood to move around and past separator 130. Assembly 10 will stabilize when the phases of blood or other liquid specimen have been fully separated, and when separator 130 is disposed between the phases. The centrifuge then can be stopped, thereby causing intermediate portions 136 of separator 130 to resiliently return to its initial shape. In this initial shape, separator 130 will sealingly engage inner surface 19 of cylindrical sidewall 18 of tube 12 for maintaining separation between the phases of blood.

A third embodiment of the separator is illustrated in FIG. 10, and is identified by the numeral 230. Separator 230 is structurally and functionally very similar to separator 130 shown in FIGS. 8 and 9. In particular, separator 230 includes a top end 232 and an opposed bottom end 234. A metal ring 246 is embedded in portions of separator 230 adjacent bottom end 234. Separator 230 differs from the separator 130 in that the seal portion 236 is substantially hollow. The hollow configuration of the seal portion 236 facilitates deformation in response to centrifugal loads and further facilitates the piercing of separator 230 by a needle cannula for depositing a sample of blood or other liquid to be separated. The thickness of the walls of the hollow seal portion 236 can be selected to achieve a targeted overall specific gravity or density for separator 230 that is between the respective specific gravities of the phases of the liquid being separated.

While the invention has been described with respect to certain preferred embodiments, it is apparent that the first embodiment may be formed with a hollow seal portion as illustrated with respect to the third embodiment and other shapes for the seal portion and the high density ring may be employed.

What is claimed is:

1. A specimen collection and separation assembly comprising:

a specimen collection tube having an open top and a closed bottom and a cylindrical wall extending therebetween, said cylindrical wall having an inner surface defining an inside diameter, a closure engaged with said open top of said tube, said closure having a top wall with a needle pierceable stopper extending across said open top of said tube;

a separator engaged in said tube between said closure and said closed bottom of said tube, said separator having opposed top and bottom ends and comprising, at or adjacent to said top end, a seal formed from a resiliently deformable material and having a portion dimensioned for sealing engagement with said inner surface of said tube, said separator further comprising, at or adjacent to said bottom end, a ring engaged with said seal, said ring having an outside diameter less than said inside diameter of said tube and being formed from a material more dense than said seal, such that said ring elongates and narrows said seal in said tube in response to a centrifugal load placed on said tube, wherein said separator includes a ballast mount unitary with said seal and extending toward said bottom end of said separator, said ring being securely engaged around said ballast mount.

2. The assembly claim 1, wherein said seal is substantially hollow.

3. The assembly of claim 2, wherein said ring is embedded in portions of said seal adjacent said bottom end of said separator.

4. The assembly of claim 1, wherein the seal is pierceable by a needle cannula and resealable upon cannula removal, and wherein it is possible to removably insert a needle cannula into the top end, through a central portion of the separator, and out the bottom end.

5. The assembly of claim 4, wherein the separator is engaged in the tube such that it is possible to direct a fluid through the needle cannula and into the bottom of the tube, without the fluid contacting the top end of the separator.

6. A separator for use with a specimen collection tube for separating of a liquid specimen into phases having different densities, said separator having opposed top and bottom ends, said separator comprising, at or adjacent to the top end, a deformable seal with an outside diameter for sealing engagement with said tube, the deformable seal having a first density, and said separator further comprising, at or adjacent to the bottom end, a ring engaged with the seal and having a second density greater than the first density, said ring having an outside diameter less than said outside diameter of said seal, wherein said separator includes a ballast mount extending unitarily from said seal to said bottom end of said separator, said ballast mount including a flange located at the bottom end of the separator and a cylindrical neck extending from the seal to the flange, and wherein said ring is of a stepped tubular configuration and has a portion surrounding the neck, the portion located between said flange and said seal.

7. The separator of claim 6, wherein said seal and the ring are formed from materials selected to define an overall density for said separator between the densities of said phases of liquid to be separated.

8. The separator of claim 6, wherein the seal is formed from a material that is pierceable by a needle cannula and resealable upon removal of said needle cannula, and wherein the separator is capable of having said needle cannula removably inserted into the top end, through a central portion of the separator, and out the bottom end.

9. The separator of claim 6, wherein said seal is formed from a thermoplastic elastomer.

10. The separator of claim 9, wherein said thermoplastic elastomer is a foam.

11. The separator of claim 6, wherein said ring is formed form a metallic material.

12. The separator of claim 6, wherein said ring is embedded in portions of said seal adjacent said bottom end of said separator.

13. The separator claim 6, wherein said seal is hollow.

14. The separator of claim 6, wherein an intermediate portion of said seal is in said sealing engagement with said tube, and said intermediate portion of said seal is cylindrical.

* * * * *